US005354067A

United States Patent [19]

Junemann

[11] Patent Number: 5,354,067

[45] Date of Patent: Oct. 11, 1994

[54] TOSSING GAME APPARATUS AND METHOD

[76] Inventor: David E. Junemann, 5522 Robin Rd., Wisconsin Rapids, Wis. 54494

[21] Appl. No.: 84,618

[22] Filed: Jul. 1, 1993

[51] Int. Cl.[5] ..... A63B 67/06

[52] U.S. Cl. ..... 273/400; 273/371; 273/424

[58] Field of Search ..... 273/317, 318, 371, 400, 273/401, 424, 425

[56] References Cited

U.S. PATENT DOCUMENTS

| | | | |
|---|---|---|---|
| 324,189 | 8/1885 | Thomas | 273/400 |
| 712,159 | 10/1902 | Voege | 273/400 |
| 2,126,245 | 8/1938 | Darby | 273/400 X |
| 3,944,227 | 3/1975 | Nilsson | 273/410 |
| 4,204,682 | 5/1980 | Brown | 273/401 |
| 5,163,684 | 11/1992 | Seidler | 273/371 X |
| 5,222,740 | 6/1993 | Wu et al. | 273/371 |

FOREIGN PATENT DOCUMENTS

| | | | |
|---|---|---|---|
| 1046834 | 12/1953 | France | 273/400 |

*Primary Examiner*—William E. Stoll
*Attorney, Agent, or Firm*—Hugh E. Smith

[57] ABSTRACT

A game apparatus and method for playing a tossing game. The apparatus includes a plurality of cup members which may be recessed into the ground and a plurality of pucks which may be tossed towards the cup members. The game is played by placing two cup members into the ground at a predetermined distance apart. Opposing players alternately toss the pucks toward one of the cup members from behind the other cup member. Scoring values are assigned for pucks landing in the cup members, overhanging the cup members, or landing a distance from the cup members defined by a diameter of the puck.

2 Claims, 3 Drawing Sheets

TOSSING GAME APPARATUS AND METHOD

BACKGROUND OF THE INVENTION

1. Field of the Invention

The present invention relates to games and more particularly pertains to tossing games which may be played by tossing a plurality of pucks towards cup members spaced a predetermined distance apart.

2. Description of the Prior Art

The use of games is known in the prior art. More specifically, games heretofore devised and utilized for the purpose of tossing objects into containers are known to consist basically of familiar, expected and obvious structural configurations, notwithstanding the myriad of designs encompassed by the crowded prior art which have been developed for the fulfillment of countless objectives and requirements.

For example, a method and apparatus for an outdoor tossing game is illustrated in U.S. Pat. No. 4,204,682. The method of playing the game has a plurality of groups of distinguishably identified markers which are tossed from behind a line towards a receptacle in an attempt to Rut the marker in the receptacle. The receptacle is recessed into the ground or other playing surface and is approximately thirty to fifty feet away from the throwing line, which may be another receptacle.

A disk scaling game is disclosed in U.S. Pat. No. 2,126,245 in which a player attempts to scale as many disks as possible for a given number of allowed trials per game into a goal pocket from a predetermined distance. The disks are hollow and include small symmetrically placed holes in the top surface so as to entrap more air and cause uneven pressure areas on the disks due to the air passing through these holes and hence cause the disk to glide, wobble, and dive through the air in a very interesting and irregular course in its passage from the player to the basket.

Another patent of interest is U.S. Pat. No. 5,060,955 which describes a game including a pair of cup members and a plurality of pucks for being tossed at the cup members. In accordance with the playing method of the present invention, the cup members are placed a preselected distance apart, and opposing players toss a selected number of pucks, alternately, at one cup member and then the other from a position behind the cup member not being targeted.

Other relevant patents include U.S. Pat. No. 3,865,377, U.S. Pat. No. 3,767,200, U.S. Pat. No. 5,011,147, and U.S. Pat. No. 4,040,626.

While these devices fulfill their respective, particular objectives and requirements, the afore mentioned patents do not describe a tossing game apparatus and method in which a variety of scoring values are assigned, whereby a player may either gain or, alternatively, lose points by surpassing a predetermined winning score. Furthermore, games mentioned heretofore do not include lighting that allows the game to be played at night. In this respect, the tossing game according to the present invention substantially departs from the conventional concepts and designs of the prior art, and in so doing provides an apparatus primarily developed for the purpose of providing a game in which a plurality of pucks which may be tossed towards a plurality of cup members recessed into the ground.

SUMMARY OF THE INVENTION

In view of the foregoing disadvantages inherent in the known types of games now present in the prior art, the present invention provides a new tossing game construction wherein the same can be utilized for playing a tossing game. As such, the general purpose of the present invention, which will be described subsequently in greater detail, is to provide a new tossing game apparatus and method which has many of the advantages of the games mentioned heretofore and many novel features that result in a tossing game which is not anticipated, rendered obvious, suggested, or even implied by any of the prior art games, either alone or in any combination thereof.

To attain this, the present invention essentially comprises a game apparatus and method for playing a tossing game. The apparatus includes a plurality of cup members which may be recessed into the ground and a plurality of pucks which may be tossed towards the cup members. The game is played by placing two cup members into the ground at a predetermined distance apart. Opposing players alternately toss the pucks toward one cup member from behind the other cup member. Scoring values are assigned for pucks landing in the cup members, overhanging the cup members, or landing a distance from the cup members defined by a diameter of the puck.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tossing game apparatus and method which has many of the advantages of the games mentioned heretofore and many novel features that result in a tossing game which is not anticipated, rendered obvious, suggested, or even implied by any of the prior art games, either alone or in any combination thereof.

It is another object of the present invention to provide a new tossing game which may be easily and efficiently manufactured and marketed.

It is a further object of the present invention to provide a new tossing game which is of a durable and reliable construction.

An even further object of the present invention is to provide a new tossing game which is susceptible of a low cost of manufacture with regard to both materials and labor, and which accordingly is then susceptible of low prices of sale to the consuming public, thereby making such tossing games economically available to the buying public.

Still yet another object of the present invention is to provide a new tossing game which provides in the apparatuses and methods of the prior art some of the advantages thereof, while simultaneously overcoming some of the disadvantages normally associated therewith.

Still another object of the present invention is to provide a new tossing game apparatus and method which includes a plurality of cup members that may be recessed into the ground and a plurality of pucks which may be tossed towards the cup members.

Yet another object of the present invention is to provide a tossing game apparatus and method which includes a variety of scoring values assigned to opposing players as a result of associated puck tosses.

Even still another object of the present invention is to provide a new tossing game apparatus and method which includes a light mounted therein so that the game may be played at night.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
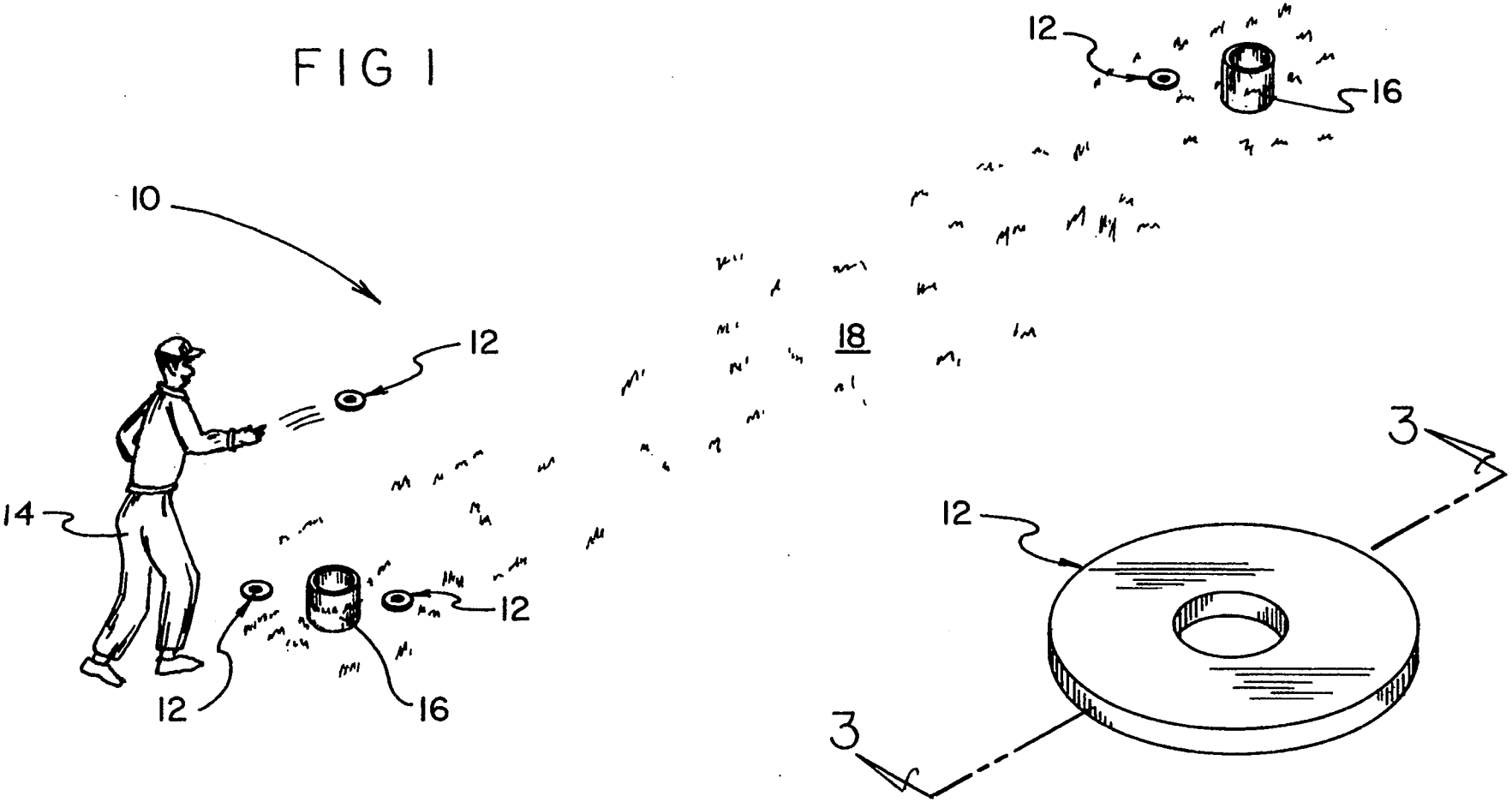
FIG. 1 is a perspective view of a tossing game comprising the present invention.
FIG. 2 is a perspective view of the present invention.
Figure 3:
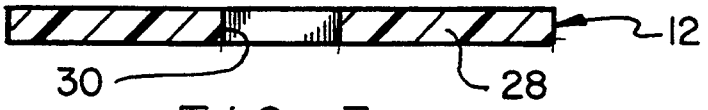
FIG. 3 is a cross-sectional view taken along line 3—3 of FIG. 2.
Figure 4:
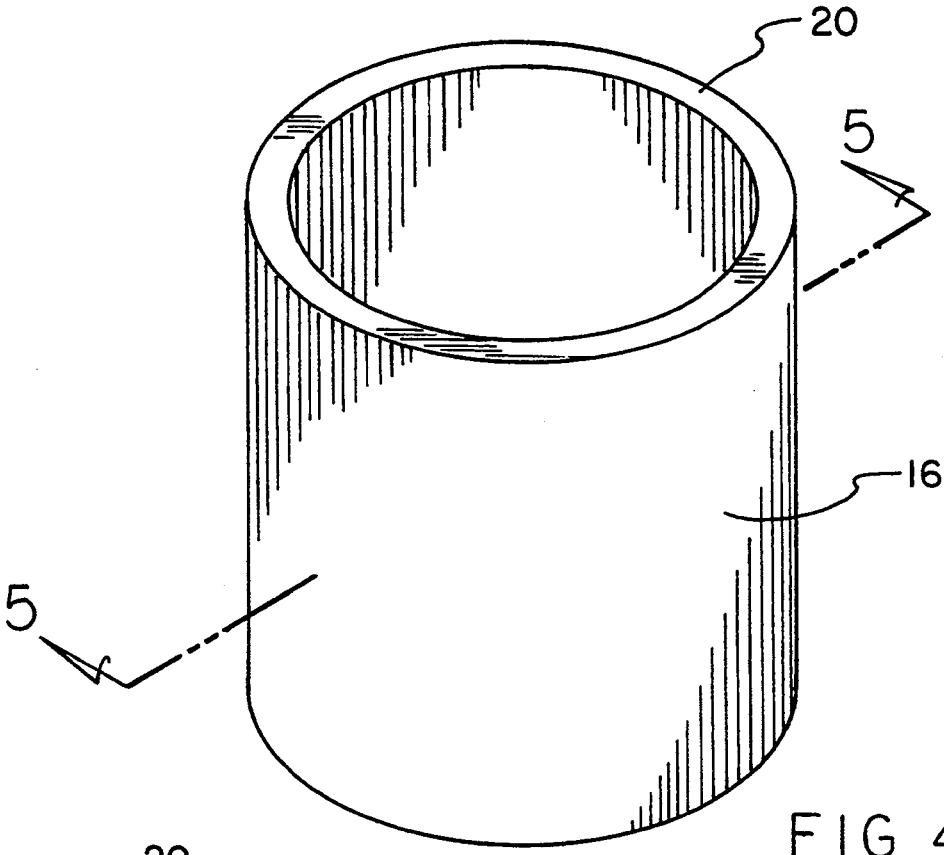
FIG. 4 is a perspective view of a portion of the invention.
Figure 5:
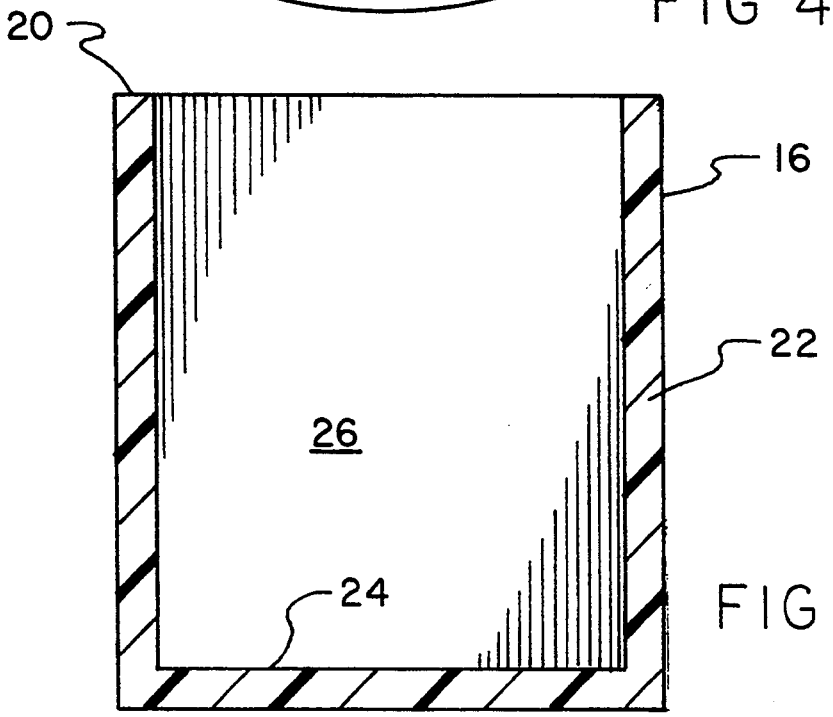
FIG. 5 is a cross-sectional view taken along line 5—5 of FIG. 4.

With reference now to the drawings, and in particular to FIGS. 1–5 thereof, a new tossing game embodying the principles and concepts of the present invention and generally designated by the reference numeral 10 will be described.

More specifically, it will be noted that the tossing game apparatus and method 10 comprises a plurality of pucks 12 which may be tossed by a player 14 into a plurality of cup members 16. Typically, a pair of cup members 16 are placed into the ground 18 so that a top rim 20 of each cup member is substantially flush with the ground. The cup members 16 are remotely spaced from one another at a predetermined distance. In play, the player 14, standing a distance away from a cup member 16 typically defined by the other cup member 16, attempts to toss one of the pucks 12 into the cup member, thereby scoring points.

The cup members 16 are each comprised of a substantially cylindrical sidewall 22 and a bottom wall 24 which is integrally or otherwise secured to the sidewall. The cylindrical sidewall 22 is sized to receive one of the pucks 12 within an interior 26 of the cup member 16. The cup member 16 may be recessed into the ground 18 so that the top rim 20 is flush therewith, or alternatively, the cup member 16 may be placed upon the ground or any other suitable playing surface.

Each of the pucks 12 is comprised of a substantially circular disk member 28 which may be received in the interior 26 of the cup members 16. The pucks 12 further include a center aperture 30 in the disk member 28 which facilitates handling during both the playing of the game and the retrieving of the pucks from the cup members 16. The pucks 12 may be of any size and shape while still being receivable within the interior 26 of the cup member 16. The pucks 12 may also include an unillustrated whistle integrally formed therein to provide noise during its travel through the air.

The tossing game 10 may be played by positioning a pair of cup members 16 at a predetermined distance apart, typically approximately fifteen feet. The cup member 16 may be recessed into the ground 18 or other playing surface, or alternatively the cup members may be positioned upon the ground or other playing surface. The players then divide themselves into teams, preferably comprising even numbers of players. Each player stands at one of the two cup members 16 opposite an opposing player. For example, for teams consisting of one player each, one player would stand at a first cup member 16 and the other player would stand at the second cup member. For teams comprising two or more members, an equal number of opposing team members would be located at each of the cup members 16. A throwing line should be determined behind which each player must stand to toss one of the pucks 12 into the cup member 16. Typically, this is determined from a location of the cup member 16 by which the player is located. Each player then tosses one of the pucks 12 towards the opposed cup member 16. In the preferred embodiment, each player tosses two pucks 12 towards the opposed cup member 16, one after the other. The opponent then scores the resulting tosses and then takes a turn at trying to throw two of the pucks 12, one after the other, into the opposed cup member 16. The opponents score is then noted and the cycle repeats.

Scoring is determined by a final resting position of the puck 12. A score of three points is given to a player who successfully tosses one of the pucks 12 into the interior space 26 of an opposed cup member 16. A score of 2 points is awarded to a player who tosses a puck 12 onto the top rim 20 of the cup member 16. A score of one point is awarded to a player who tosses a puck 12 which lands upon the ground 18 or other playing surface within a distance from the cup member 16 defined by a diameter of the puck.

The game may be won by obtaining a predetermined number of points, typically 15 points or more. If a player exceeds the predetermined winning score, the player's score before the toss will be reduced by the number of points gained in the toss. For example, if a player has 13 points and successfully tosses one of the pucks 12 into an opposed cup member 16, he will have exceeded a winning score of fifteen which will cause his original score of thirteen to be reduced to ten.

For teams of two or more, a players score from a previous toss may be canceled out should the opponent player obtain an identical score from a toss immediately thereafter. Teams of two or more must also obtain the predetermined winning score without exceeding it or they will be subject to the reduction of their score as described above.

Figure 6:
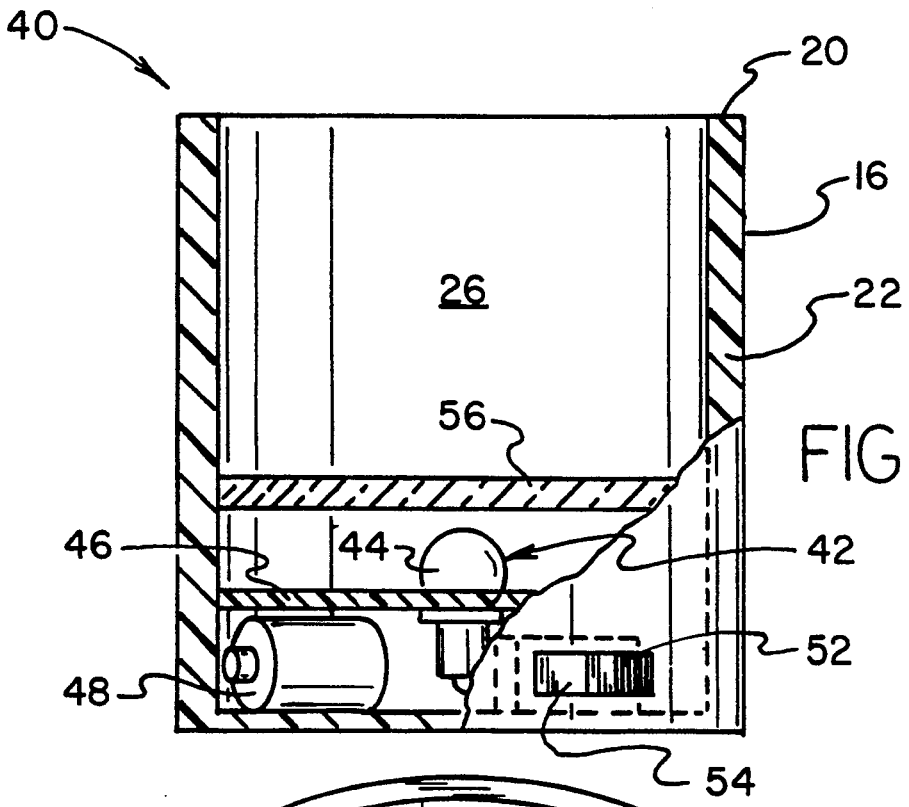
FIG. 6 is a side elevation view, partially in cross-section, of a second embodiment of the present invention.

A second embodiment of the present invention as generally designated by the reference numeral 40, which comprises substantially all of the features of the foregoing embodiment 10 and which further comprises a light assembly 42 will now be described. As best shown in FIG. 6, it can be shown that the light assembly 42 is positioned upon the bottom wall 24 in the interior 26 of the cup members 16. The light assembly 42 includes a bulb 44 mounted upon a bulb support 46 which is integrally or otherwise connected to the cylindrical sidewall 22. The bulb support 46 is supported in a plane substantially parallel to the bottom wall 24 and positioned substantially away therefrom to allow a battery 48 and a switch 50 to reside therebetween. The battery 48 and the switch 50 are both electrically connected to the bulb 44 in a conventional manner so that an operation of the switch will allow the bulb to operate. The switch 50 includes a lever 52 which projects through an aperture 54 in the cylindrical sidewall 22 to allow a user to readily operate the switch. A lens 56 is located within the interior 26 of the cup member 16 and is positioned in a plane substantially parallel to the bottom wall 24. The lens 56 is operable to protect the bulb 44 from an impact of the pucks 12 while allowing a passage of light generated from the bulb therethrough. The light assembly 42 may be operated in a well understood manner to provide a visibility of the cup members while playing the tossing game 10 at night or in darkened areas. The switch 50 may alternatively be located within the interior 26 of the cup member 16 so that the cup member may be inserted into the ground 18 or other playing surface.

Figure 7:
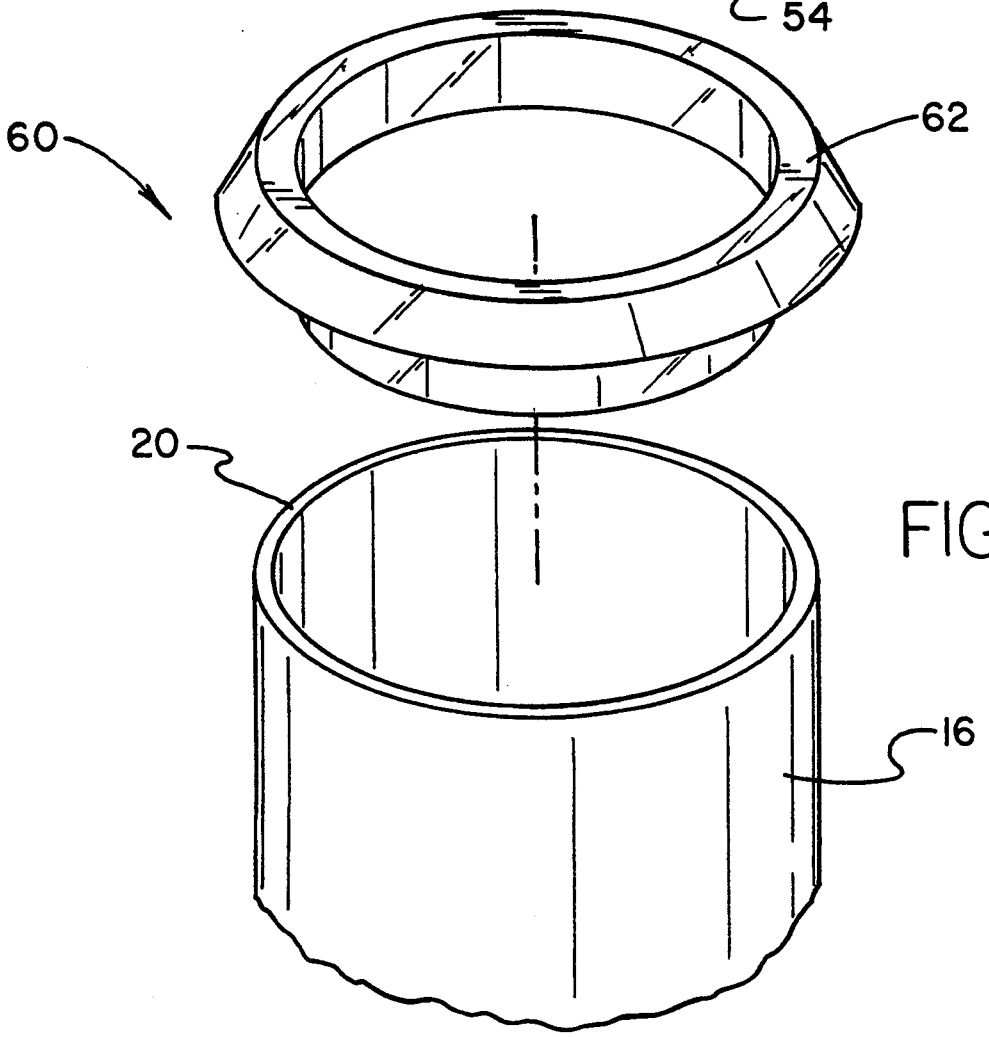
FIG. 7 is a perspective view of a third embodiment of the present invention.

Comprising all of the features and structure of the previous embodiments 10, 40 is a third embodiment which is generally designated by the reference numeral 60 and may be viewed in FIG. 7. It can be shown that the third embodiment 60 further comprises a diffuser 62 which may be positioned upon the top rim 20 of the cup member 16. The diffuser 62 is comprised of any substantially transparent or translucent material and is operable to diffuse light emitted from the light assembly 42 around a perimeter area of the cup member 16. A diffuser 62 substantially illuminates the top rim 20 of the cup member 16 to provide an increased visibility thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An apparatus for playing a tossing game, said apparatus comprising:

at least one cup member;

at least one puck having a center aperture therethrough, said puck being operable to fit within an interior of said cup member;

a light assembly mounted within the interior of said cup member;

and, a diffuser releasably coupled to a top rim of said cup member for diffusing light radiating from said light assembly.

2. The apparatus for playing a tossing game of claim 1, wherein said light assembly comprises a bulb electrically connected to both a battery and a switch, said switch being operable to selectively energize said bulb.

* * * * *